US006305995B1

(12) United States Patent
Stauning et al.

(10) Patent No.: US 6,305,995 B1
(45) Date of Patent: Oct. 23, 2001

(54) DETACHABLE FIREFIGHTING ATTACHMENT FOR A PERSONAL WATERCRAFT

(76) Inventors: Paul Stauning; Verner Stauning, both of 12625 - 104 Avenue, Surrey British Columbia (CA), V3V 3H8

( * ) Notice: Subject to any disclaimer, the term of this patent is extended or adjusted under 35 U.S.C. 154(b) by 0 days.

(21) Appl. No.: 09/484,980

(22) Filed: Jan. 18, 2000

(51) Int. Cl.[7] ..... B63H 11/00
(52) U.S. Cl. ..... 440/39; 114/55.5
(58) Field of Search ..... 114/55.5; 440/38, 440/39

(56) References Cited

U.S. PATENT DOCUMENTS

| | | | | |
|---|---|---|---|---|
| 3,339,516 | * | 9/1967 | Lenci | 440/39 |
| 3,613,630 | | 10/1971 | Jacuzzi | 115/12 R |
| 4,699,597 | * | 10/1987 | Oja | 440/39 |
| 5,299,960 | | 4/1994 | Day et al. | 440/39 |
| 5,516,313 | | 5/1996 | Lumpkin | 440/39 |
| 5,616,057 | | 4/1997 | Sundholm | 440/39 |

FOREIGN PATENT DOCUMENTS

| | | | | |
|---|---|---|---|---|
| 404066387 | * | 3/1992 | (JP) | 440/39 |

* cited by examiner

*Primary Examiner*—Stephen Avila
(74) *Attorney, Agent, or Firm*—Norman M. Cameron

(57) ABSTRACT

A detachable firefighting attachment is provided for a personal watercraft having a discharge nozzle. The attachment includes a tubular body having a lower end and upper end. There is a firefighting nozzle mounted on the upper end of the body. A fitting at the lower end of the body is shaped to fit the discharge nozzle of the personal watercraft. Water discharged from the discharge nozzle passes through the conduit to the firefighting nozzle. A forward mount is connected to the body and includes a first component releasibly connectable to the personal watercraft. There may be a steering nozzle communicating with the body adjacent to the fitting. There may be a diverter within the body adjacent to the steering nozzle for diverting water from the personal watercraft through the steering nozzle.

20 Claims, 7 Drawing Sheets

DETACHABLE FIREFIGHTING ATTACHMENT FOR A PERSONAL WATERCRAFT

BACKGROUND OF THE INVENTION

This invention relates to firefighting equipment and, in particular, to equipment for discharging water from personal watercraft.

Fires often occur aboard vessels, in other floating structures or in structures adjacent to the water such as wharves or warehouses. Dedicated fire boats are commonly used to combat such fires. However these boats are traditionally large and expensive. Therefore they are impractical for many locations. In addition, many locations are difficult or impossible to access by land-based firefighters.

Consequently, there is a need for relatively inexpensive equipment capable of fighting fires aboard boats, other floating equipment or waterside structures. In the past various attempts have been made to provide equipment capable of supplying a stream of water for fighting fires from smaller craft such as outboard motor-powered boats and personal watercraft, usually known as jet skis.

For example, U.S. Pat. No. 5,516,313 shows a firefighting accessory for jet propulsion systems. Two variations are intended for outboard propulsion systems, while one variation is intended for inboard type jet propulsion systems. In one embodiment an accessory is placed between the outlet end of the drive tube and the jet nozzle with attached steering nozzle. There is a flap valve which allows diversion of water through the steering nozzle or the firefighting nozzle.

U.S. Pat. No. 4,699,597 shows the general idea of a firefighting attachment for outboard motors.

U.S. Pat. No. 5,299,960 shows an auxiliary water projector for jet propelled watercraft.

U.S. Pat. No. 3,613,630 to Jacuzzi discloses jet propulsion devices for vessels and firefighting equipment applied thereto.

U.S. Pat. No. 5,616,057 discloses a ship having a water-injecting means for driving the ship and spraying water.

However, these devices have not met with widespread acceptance. The main reason is the inability to steer, causing the water stream to miss the target, especially in conditions of winds and currents. Another reason for this is that some prior art devices are not readily attachable to and detachable from personal watercraft. With some earlier devices the personal watercraft effectively has to be permanently dedicated to firefighting. This is not always practical. For example, it may be desired to have the personal watercraft used for other purposes, such as rescue operations. If a fire develops, then it would be desirable to quickly adapt such personal watercraft for firefighting by easily attaching required equipment for training a stream of water on the fire.

Also, some prior art devices are not convenient to use. A single operator must be capable oftraining a stream of water on the fire while maneuvering the personal watercraft to achieve the desired position or to maintain a desirable position in spite of winds and currents. This means that the controls must be readily capable of operating the craft and controlling the stream of water at the same time.

Accordingly, it is an object of the invention to provide an improved firefighting attachment for a personal watercraft which can be readily attached to the personal watercraft and detached from the personal watercraft as required.

It is also one object of the invention to provide an improved firefighting attachment for personal watercraft which allows the personal watercraft to be easily maneuvered while an operator simultaneously trains a stream of water on a fire.

It is a further object of the invention to provide an improved firefighting attachment for personal watercraft which is simple and rugged in construction, reliable and simple to operate.

SUMMARY OF THE INVENTION

In accordance with these objects, there is provided, according to the invention, a detachable firefighting attachment for a personal watercraft having a discharge nozzle. The attachment includes a tubular body having a lower end an upper end. A firefighting nozzle is mounted on the upper end of the body in communication with the body. There is a fitting at the lower end of the body shaped to fit the discharge nozzle of the personal watercraft. Water discharged from the discharge nozzle passes through the body to the firefighting nozzle. There is a forward mount connected to the body. The forward mount includes a first component releasibly connectable to the personal watercraft.

Preferably there is a rearward mount which has a fixed component fixedly mounted on the personal watercraft and a body component mounted on the body. For example, the fixed component may include a pin and the body component may include a rearward latch mechanism releasibly engagable with the pin.

There may be a steering nozzle communicating with the body adjacent to the fitting. In one preferred embodiment there is a diverter within the body adjacent to the steering nozzle for diverting water from the personal watercraft through the steering nozzle.

DETAILED DESCRIPTION OF THE PREFERRED EMBODIMENTS

Figure 1:
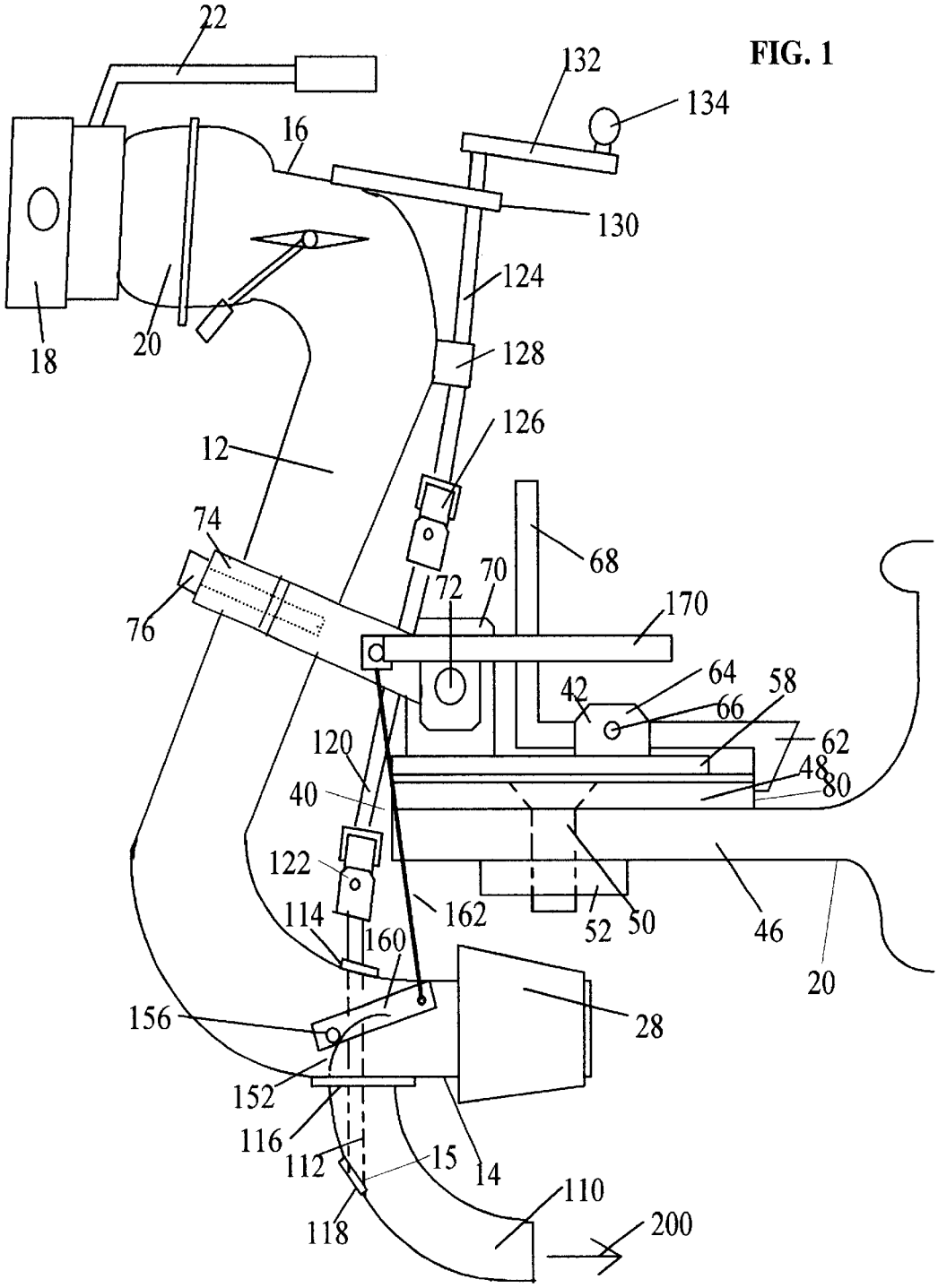
FIG. 1 is a side elevational view, partly in section, of a firefighting attachment for a personal watercraft, according to an embodiment of the invention, shown in the lowered position for use in fighting fires, and a fragment of the stern of a personal watercraft.

Referring to the drawings, and first to FIG. 1, this shows a detachable firefighting attachment 10 for a personal watercraft 20, only the stern of which is shown. The attachment includes a tubular body 12 which generally S-shaped in this embodiment. It has a lower end 14 and an upper end 16. There is a conventional firefighting nozzle 18 connected to the upper end by a swivel 20. There is a handle 22 connected to the nozzle which allows it to be manually swivelled. A truncated conical fitting 28 is mounted on the lower end of the body and is shaped to fit aft end 31 of discharge nozzle 30 at the stern of the personal watercraft as shown best in FIGS. 2 and 4. The fitting 28 in this embodiment is of a resilient material, such as rubber or a synthetic substitute. Therefore water discharged from the discharge nozzle 30 normally passes through the body 12 to the firefighting nozzle 18.

Figure 1A:
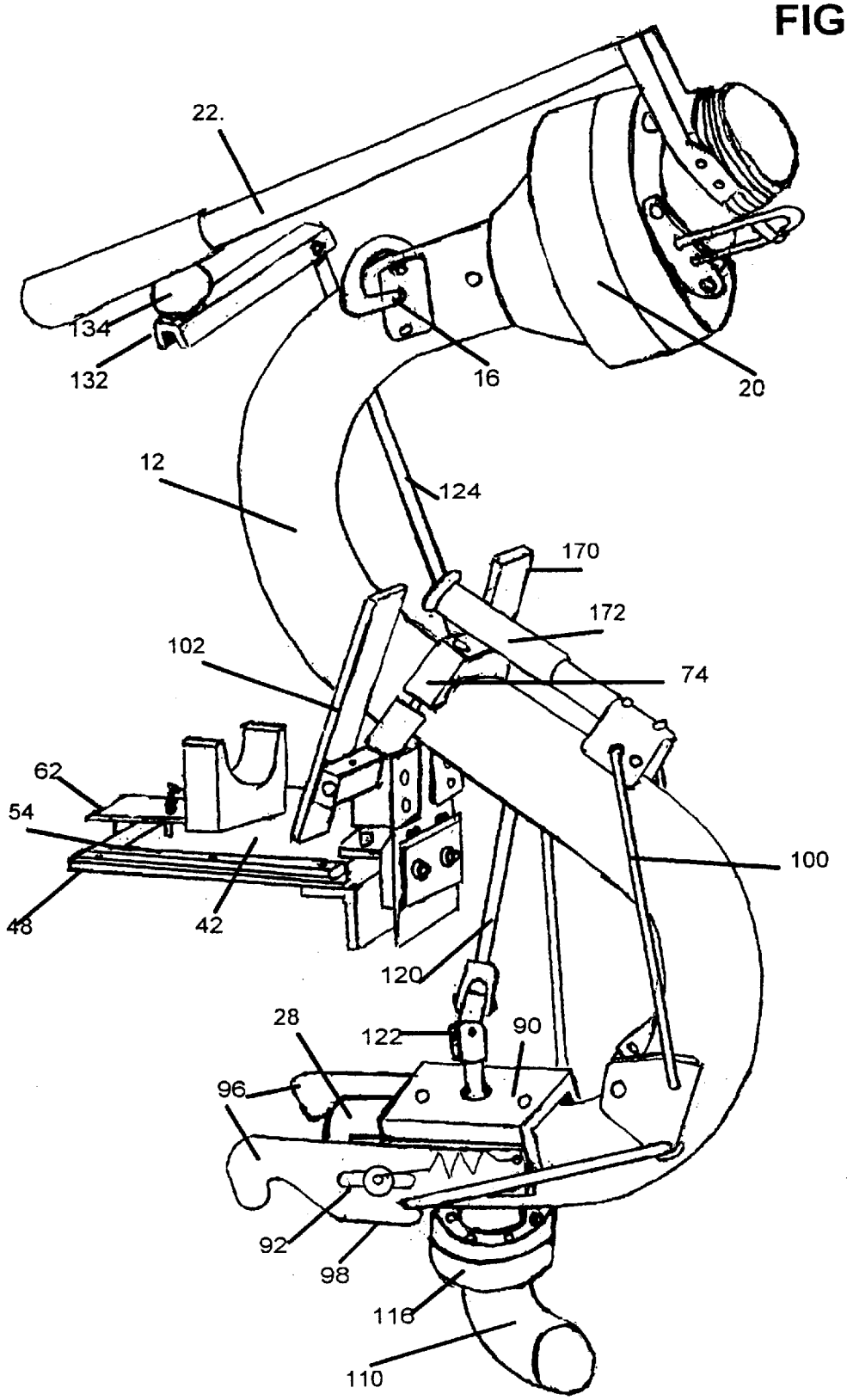
FIG. 1*a* is a rear isometric view thereof in the lowered position.

The body is mounted on the personal watercraft by means of a forward mount shown generally at 40 in FIG. 1 and a rearward mount 60 shown in FIG. 1*a*. Referring first to the forward mount, there is a first component 42 which is releasibly connected to the personal watercraft. There is a second component, shown generally at 44, which is fixedly mounted on the watercraft, in this case on platform 46 at the stern thereof.

Figure 5:
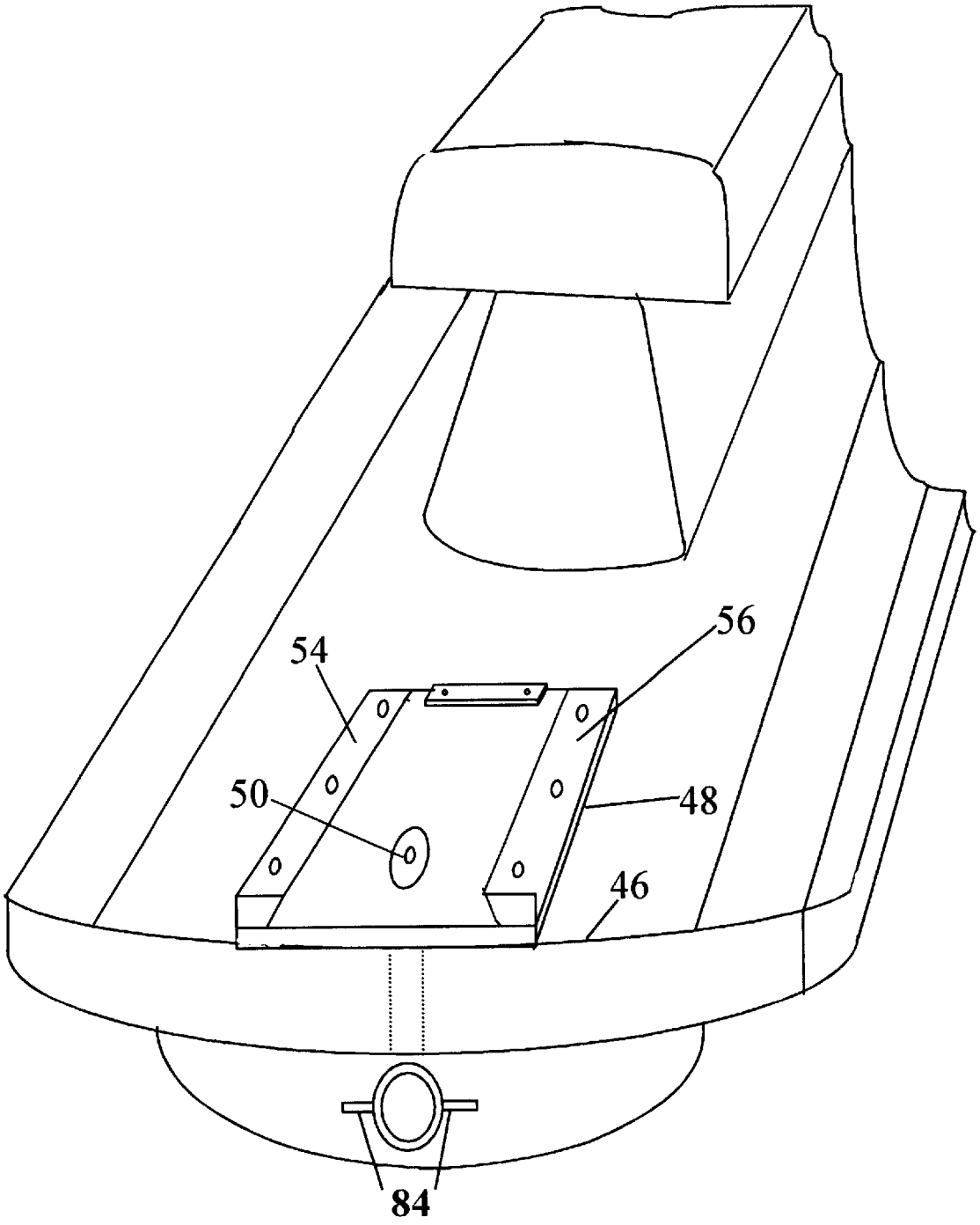
FIG. 5 is an isometric view of the second component of the forward mount which is fixedly mounted on the stern of the watercraft shown in fragment.
Figure 6:
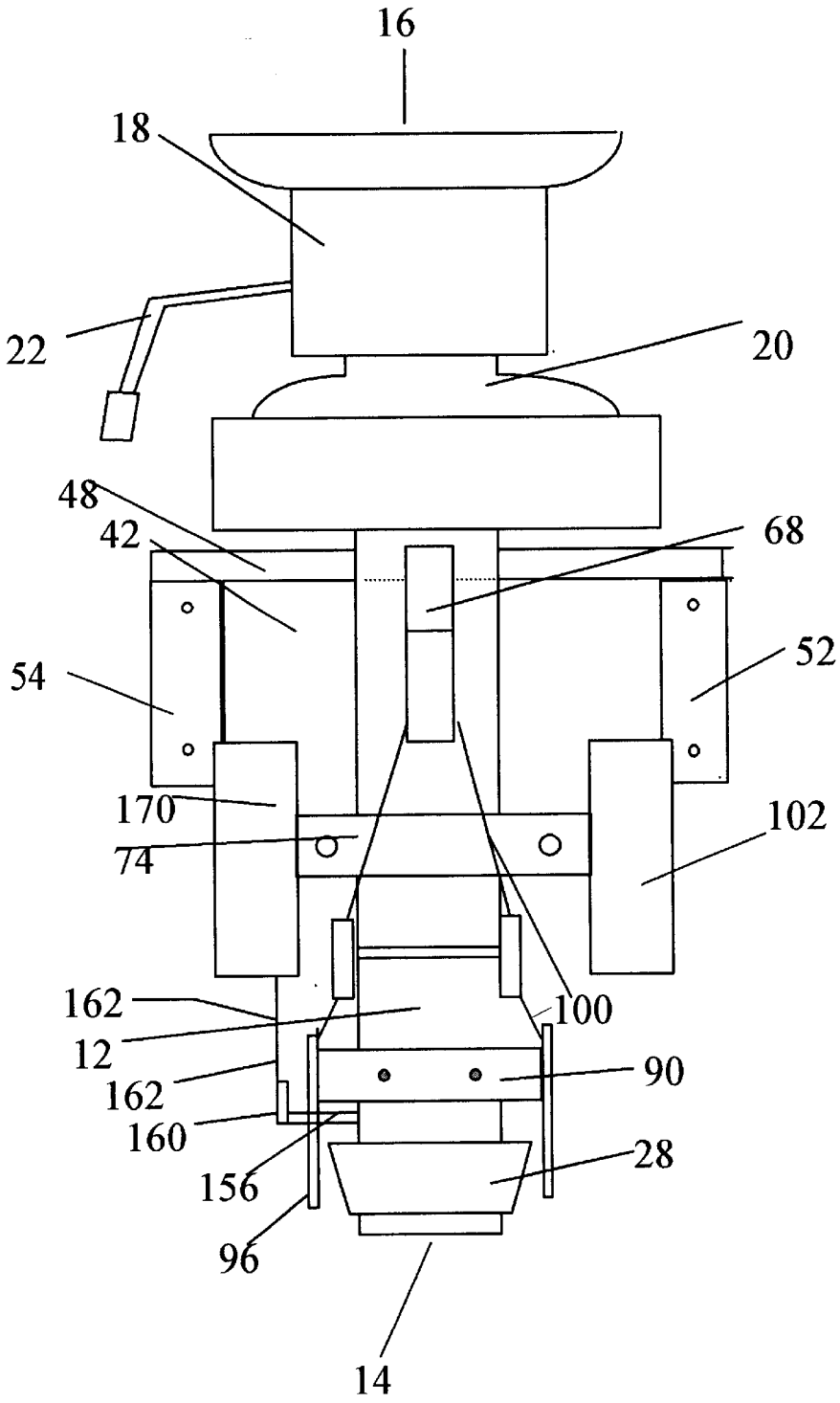
FIG. 6 is a top view, partly in section, of a firefighting attachment for a personal watercraft.

The second component includes a mounting plate 48 which is mounted on the platform 46 by a series of bolts 50 extending through the platform and engaging a plate 52 below the platform. As seen in FIG. 5, a pair of spaced-apart guide tracks 54 and 56 extend longitudinally along the top of the plate 48.

The first component of the forward mount includes a plate 58 which is slidably receivable on top of plate 48 between the guide tracks 54 and 56. A latch 62 is pivotally connected to plate 58 by means of a bracket 64 and a pivot pin 66. A handle 68 is connected to the latch.

A bracket 70 is connected to the plate 58 adjacent to the rear end thereof. A pivot pin 72 pivotally connects the bracket to a clamp 74 which extends about the body 12 generally near the middle thereof. A plurality of bolts 76 secure the clamp tightly about the body. The body 12 is mounted on the personal watercraft by sliding plate 58 forwardly over plate 48 between the guide tracks 54 and 56 until latch 62 engages front end 80 of plate 48 as shown in FIG. 1. The first component of the forward mount is released from the watercraft by pulling on lever 68 to the right, from the point of view of FIG. 1, to lift the latch 62 away from the plate 48. Plate 58 is then free to slide rearwardly to detach the firefighting attachment 10, assuming the rearward mount 60 is released as described below.

The rearward mount 60 has a fixed component fixedly mounted on the personal watercraft. In this embodiment the fixed component is a pair of pins 84, only one of which is seen on FIG. 4, connected to the side of discharge nozzle 30. An identical pin is mounted on the opposite side.

Figure 4:
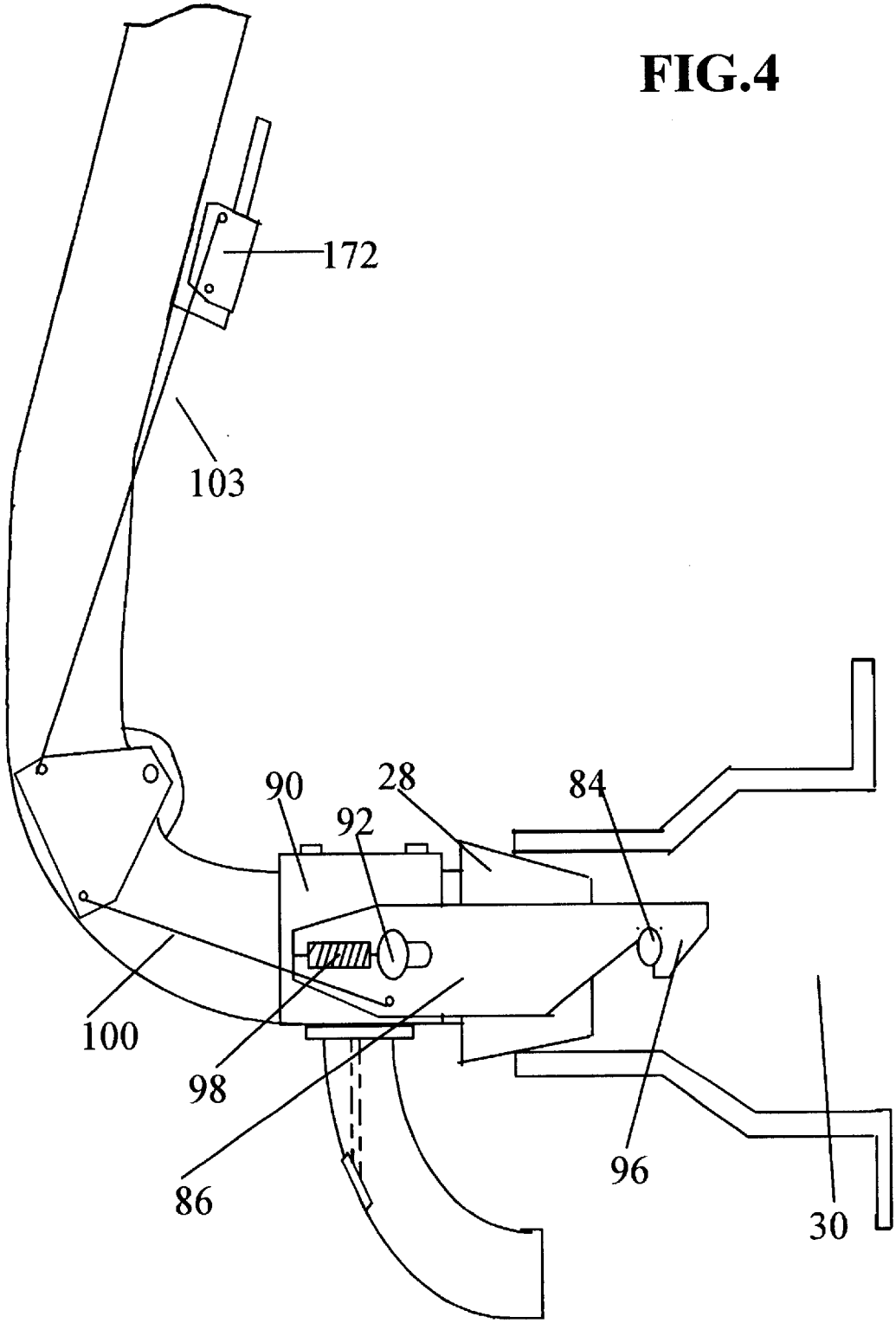
FIG. 4 is a fragmentary side view thereof showing the steering nozzle and rearward mount.

The rearward mount includes a body component in the form of a pair of ganged-together bell cranks 86 and 88, shown in FIG. 1 a and FIG. 4, which are pivotally mounted on inverted channel-shaped housing 90 by a pivot pin 92. The forward ends of each of the bell cranks is formed into the shape of a latch 96 for releasibly engaging one of the pins 84. A coil spring 98 biases the latches into engagement with the pins. A rod 100 operatively connects the bell cranks to a bell crank 101. Another rod 103 connects bell crank 101 to a self-locking handle 172. Thus the latches 96 automatically engage the pins 84 when the body 12 is pivoted downwardly about pin 72 to the position shown in FIG. 1 and 2. This holds fitting 28 securely within the discharge nozzle of the personal watercraft so all of the water is diverted through body 12.

A steering nozzle 110 is located rearwardly of the fitting 28 and adjacent thereto has seen in FIG. 1. The nozzle in this example is elbow-shaped. It is rotatably mounted on the body 12 by a shaft 112 extending through bearings 114 and 116. The bearings are of nylon in this example. The shaft is connected fixedly to a plate 118 within the steering nozzle, by welding in this example. Shaft 112 is operatively connected to a shaft 120 above by a universal joint 122. Likewise shaft 120 is connected to a shaft 124 above it by another universal joint 126. The shaft 124 is rotatably supported by brackets 128 and 130 connected to the body 12 near the top thereof. A lever 132 with a handle 134 extend perpendicularly from the top of shaft 124. The handle 134 thereby can be used to rotate the steering nozzle 110 up to a full 360 degrees.

Figure 2:
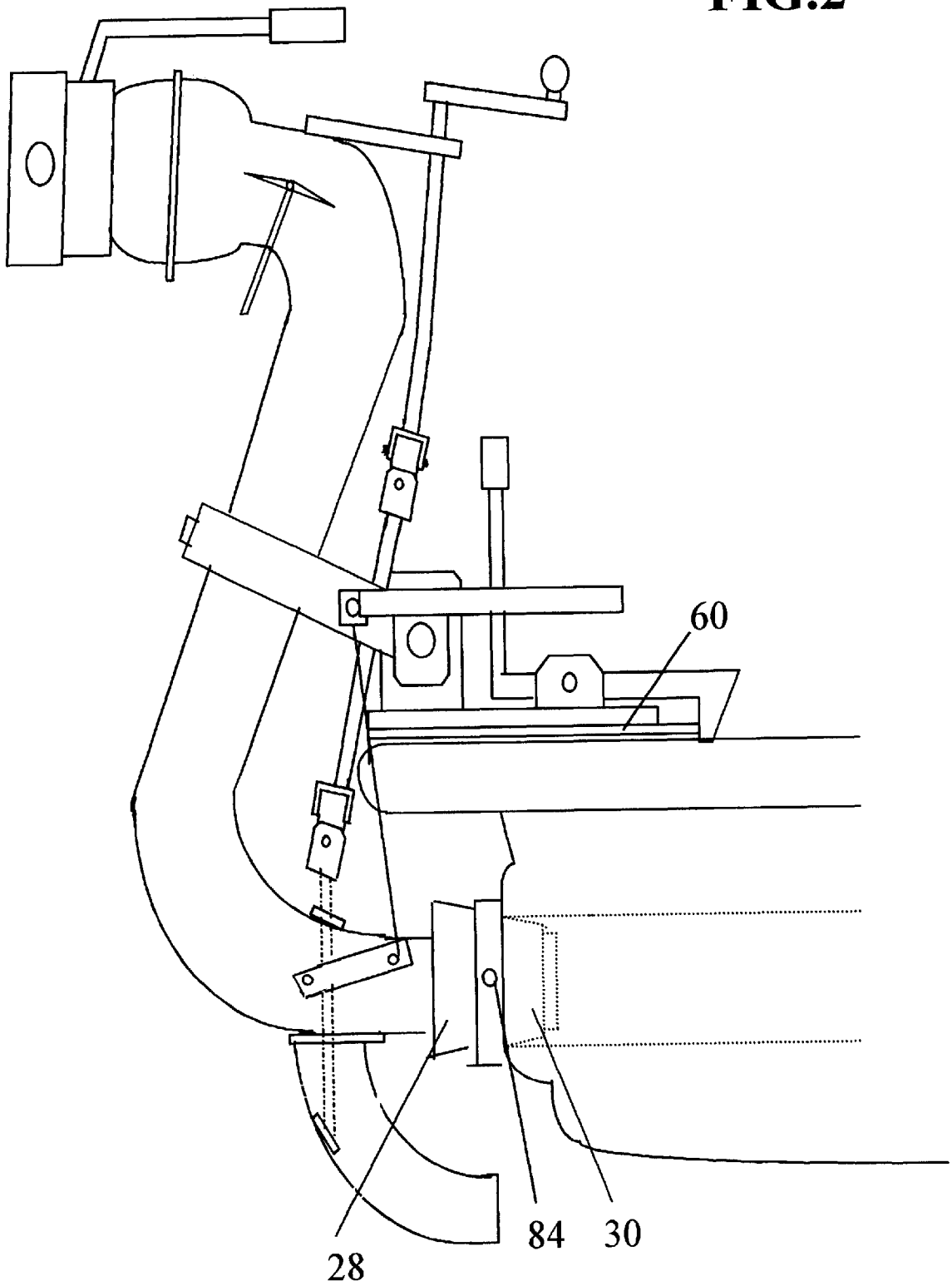
FIG. 2 is a view similar to FIG. 1 showing the discharge nozzle in ghost.
Figure 3:
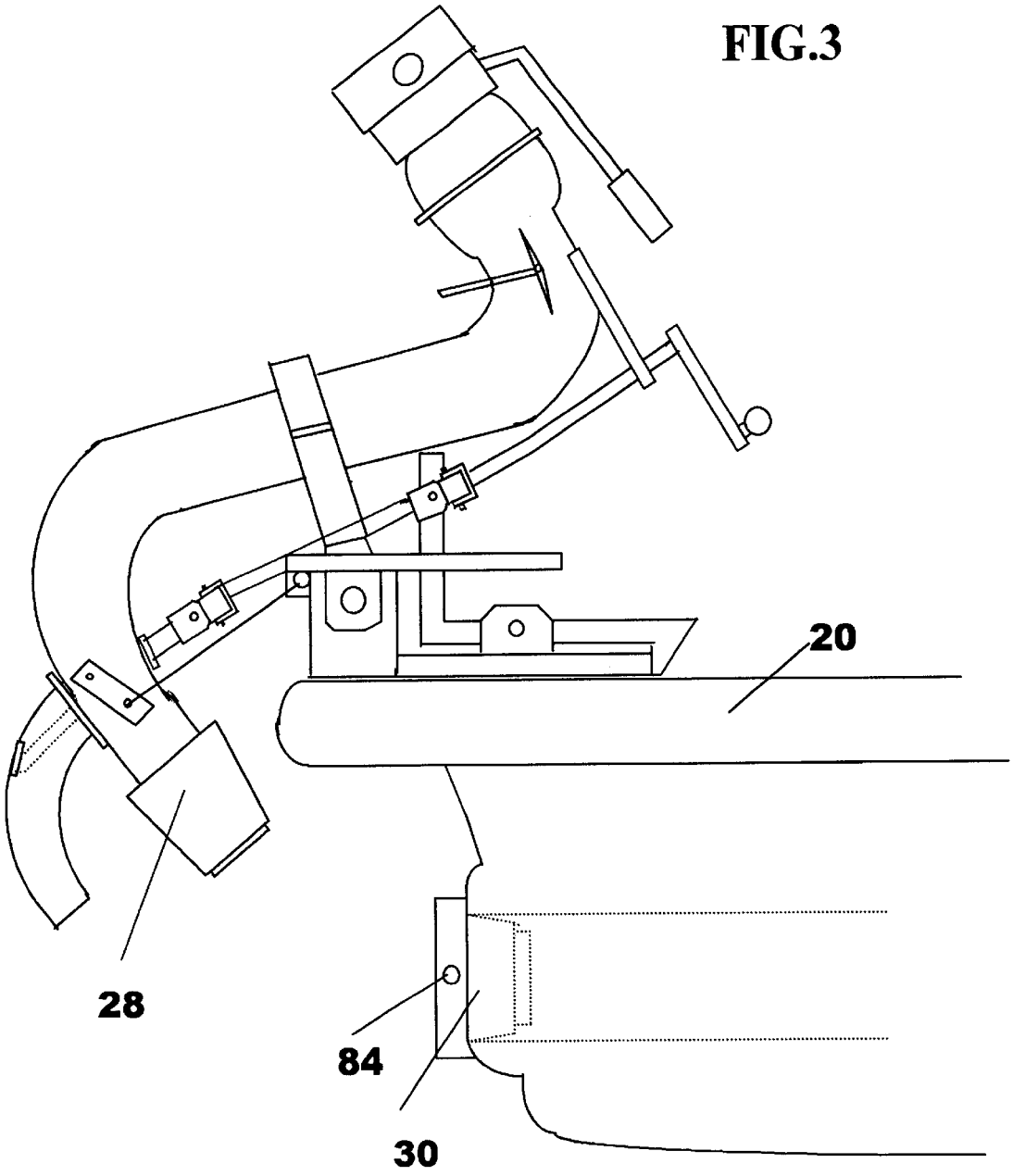
FIG. 3 is a side elevational view thereof in the raised position.

A diverter 150, shown in FIG. 1 and FIG. 2, is used to divert water discharged from the discharge nozzle of the personal watercraft partially and selectively through the steering nozzle 1 10. The diverter includes a flap (or scoop) 152 within the conduit 24. The flap is pivotally mounted by means of a pin 156 extending through the sides of the body 12. A lever 160 connects the flap to a rod 162 which is pivotally connected to foot pedal 170. When the peddle 170 is depressed, it raises the lever 160 and rotates flap 152 downwardly to divert more water into the steering nozzle. Shaft 156 is located below center on tubular body 12 as seen in FIG. 1. The flap or scoop 152 is shaped so, regardless of position, a sufficient amount of water pressure is present to feed nozzle 18 at all times and still feed nozzle 110. Thus the pedal 170 is used to control the amount of water diverted into the steering nozzle 110 and thus the speed of the personal watercraft in the direction opposite water discharged from nozzle 1 10 as illustrated by arrow 200.

It would be understood by someone skilled in the art that many of the details provided by way of example only and may be deleted or modified without departing from the scope of the invention has set out in the following claims.

What is claimed is:

1. A detachable firefighting attachment for a personal watercraft having a discharge nozzle, comprising:

a tubular body having a lower end and an upper end;

a firefighting nozzle mounted on the upper end of the body;

a fitting at the lower end of the body shaped to fit the discharge nozzle of the personal watercraft, whereby water discharged from the discharge nozzle passes through the body to the firefighting nozzle; and a forward mount connected to the body, the forward mount including a first component releasibly connectable to the personal watercraft, the first component including a forward latch mechanism, and a second component fixedly mountable on the watercraft, the forward latch mechanism releasibly connecting the first component to the second component.

2. A firefighting attachment as claimed in claim 1, wherein the second component includes a mounting plate and the first component includes a member slidably receivable on the mounting plate.

3. A firefighting attachment as claimed in claim 2, wherein the body is hingedly connected to the first component.

4. A firefighting attachment as claimed in claim 1, wherein the fitting is a resilient conical member.

5. A firefighting attachment as claimed in claim 1, including a steering nozzle communicating with the body adjacent to the fitting.

6. A firefighting attachment as claimed in claim 5, wherein the steering nozzle is rotatably mounted on the body.

7. A firefighting attachment as claimed in claim 6, wherein the body has a bottom, the steering nozzle being mounted on the bottom of the body.

8. A firefighting attachment as claimed in claim 7, wherein the steering nozzle is elbowshaped.

9. A firefighting attachment as claimed in claim 8, including a steering mechanism operatively coupled to the steering nozzle.

10. A firefighting attachment as claimed in claim 9, wherein the steering mechanism includes a steering lever and a plurality of shafts interconnected by universal joints.

11. A firefighting attachment as claimed in claim 1, wherein the body is S-shaped.

12. A firefighting attachment as claimed in claim 11, including a swivel connecting the firefighting nozzle to the body.

13. A firefighting attachment as claimed in claim 1, including a rearward mount which has a fixed component fixedly mounted on the personal watercraft and a body component mounted on the body.

14. A firefighting attachment as claimed in claim 13, wherein fixed component of the rearward mount is mounted adjacent to the discharge nozzle of the personal watercraft and the body component is mounted adjacent to the fitting.

15. A firefighting attachment as claimed in claim 14, wherein the fixed component includes a pin and the body component includes a rearward latch mechanism releasibly engagable with the pin.

16. A firefighting attachment as claimed in claim 6, having a diverter within the body adjacent to the steering nozzle for diverting water from the personal watercraft through the steering nozzle.

17. A firefighting attachment as claimed in claim 16, wherein the diverter is adjustable.

18. A firefighting attachment as claimed in claim 17, wherein the diverter is a flap valve.

19. A firefighting attachment as claimed in claim 18, including a manually operable linkage operatively connected to the flap valve.

20. A firefighting attachment as claimed in claim 19, wherein the linkage includes a foot pedal mounted on the forward mount.

* * * * *